US008739351B2

(12) United States Patent
Kling et al.

(10) Patent No.: US 8,739,351 B2
(45) Date of Patent: Jun. 3, 2014

(54) TOOTHBRUSH

(75) Inventors: Bjoern Kling, Glashuetten (DE); Andreas Birk, Kronberg/Taunus (DE)

(73) Assignee: Braun GmbH, Kronberg (DE)

( * ) Notice: Subject to any disclaimer, the term of this patent is extended or adjusted under 35 U.S.C. 154(b) by 323 days.

(21) Appl. No.: 13/233,776

(22) Filed: Sep. 15, 2011

(65) Prior Publication Data

US 2012/0036662 A1 Feb. 16, 2012

Related U.S. Application Data

(63) Continuation-in-part of application No. PCT/IB2010/051193, filed on Mar. 18, 2010.

(30) Foreign Application Priority Data

Mar. 18, 2009 (EP) ..... 09003870

(51) Int. Cl.
*A46B 9/04* (2006.01)

(52) U.S. Cl.
USPC ..... 15/167.1; 15/172

(58) Field of Classification Search
USPC ..... 15/167.1, 172
See application file for complete search history.

(56) References Cited

U.S. PATENT DOCUMENTS

| | | | | |
|---|---|---|---|---|
| 5,146,645 | A * | 9/1992 | Dirksing | 15/167.1 |
| 5,758,380 | A * | 6/1998 | Vrignaud | 15/106 |
| 6,883,200 | B1 * | 4/2005 | Euler | 15/167.1 |
| 8,032,968 | B2 * | 10/2011 | ekercioğlu et al. | 15/143.1 |
| 2008/0184511 | A1 | 8/2008 | Brown et al. | |
| 2009/0188063 | A1 * | 7/2009 | Baertschi et al. | 15/167.1 |

FOREIGN PATENT DOCUMENTS

| | | |
|---|---|---|
| EP | 0648448 | 4/1995 |
| WO | WO2008017996 | 2/2008 |

* cited by examiner

*Primary Examiner* — Laura C Guidotti
(74) *Attorney, Agent, or Firm* — George Henry Leal; Vladimir Vitenberg

(57) ABSTRACT

A toothbrush having a handle, a head with oral care elements and a neck connecting the head with the handle is described. The toothbrush has a base structure of the handle, and the neck and the head are formed by a hard plastic component. Said basic structure of the handle is covered, at least in part, by a first soft plastic component. Said head including a second soft plastic component and said neck including a through-opening, wherein at least one section of a boundary wall of the opening is provided with an elastic muscle.

10 Claims, 3 Drawing Sheets

TOOTHBRUSH

CROSS REFERENCE TO RELATED APPLICATION

This application is a continuation-in-part application of prior copending International Application No. PCT/IB2010/051193, filed Mar. 18, 2010, designating the United States which is incorporated herein by reference in its entirety.

FIELD OF THE INVENTION

This invention relates to a toothbrush according and more particularly to manual toothbrushes.

BACKGROUND OF THE INVENTION

Toothbrushes which have a neck region having an opening in the neck which extends in a direction transverse to the toothbrush bristles are known. This opening is intended generally to permit better adaptability of the toothbrush head to the dental cleansing process in the mouth. As a result, the reduced cross sections in the neck region provide greater elasticity and therefore better, but also more abrupt, compliance of the brush head. With these known toothbrushes it has been shown however that a controlled handling of the head in the mouth is greatly impeded in disadvantageous manner. This applies in particular to a brushing technique using the Bass method and to other methods in which forces are exerted on the head in various axial directions during brushing.

U.S. Patent Application No. 2008/0184511 A1 also discloses a toothbrush whose head segments are able to adapt during the tooth cleaning process particularly well to the tooth surface which is to be cleaned.

There is a need to provide a toothbrush of the type initially referred to which on the one hand can be used particularly ergonomically and on the other hand can still be used for a controlled dental cleansing operation.

SUMMARY OF THE INVENTION

By providing an opening in the neck of the toothbrush, whose basic structure is formed by a hard plastic component, it is possible to positively influence the compliance of not only the neck but also the head. For enhanced compliance in the axial directions of the head of relevance for the brushing technique, use is made of an elastic muscle which is provided on a section of the boundary wall of the opening in order to absorb shear forces or tensile forces at selected sites. Thanks also to the elastic muscle, any too abrupt compliance of the head and the neck is avoided when a force is exerted onto the head. The elastic muscle in combination with the adjoining opening in the neck permits a highly controlled modulation of the neck's flexing ability in predefined axial directions.

In another advantageous embodiment, the elastic muscle is formed by a third soft plastic component. A soft plastic component such as a thermoplastic elastomer may be compressed or expanded without giving rise to cracking, while guaranteeing at the same time that the toothbrush can be efficiently manufactured by the multi-component injection-molding process. The soft plastic component can absorb forces which arise at the boundary wall of the opening with increased intensity while brushing the teeth, as a result of which a larger range of tolerance is realized for the controlled elastic deformation of the neck during brushing.

In another advantageous embodiment, the third soft plastic component is identical to the first soft plastic component.

This reduces the complexity of tooling required for the multi-component injection-molding process. The third soft plastic component is joined directly to the first soft plastic component or is joined to it through a connecting channel. Alternatively, the third soft plastic component can be configured to be completely separate from the first soft plastic component in the handle of the toothbrush so that the third soft plastic component or the elastic muscle is directly enclosed only by the hard plastic component of the neck.

In another advantageous embodiment, the opening is encompassed by two lateral boundary walls, one front boundary wall adjacent to the head and one rear boundary wall arranged adjacent to the handle, with the elastic muscle being provided only at one of the lateral, front or rear boundary walls. Therefore the elasticity characteristic provided by the hard plastic component in the neck still prevails around the opening, with an enhanced elasticity being provided around the opening at a selected one of the loading sides of the opening's boundary wall. This allows in particular the manufacture of toothbrushes which can be optimized for certain brushing techniques. In addition it is thus possible to establish a continuous flexural characteristic over a relatively long region of head, neck and handpiece.

In another advantageous embodiment, the opening is configured to have a width of between about 1.5 to about 7 mm or any number or range including or within these values, between the two lateral boundary walls. The opening width can vary along the longitudinal extension of the toothbrush neck or it can remain substantially constant.

In another advantageous embodiment, the opening is configured to have a length of between about 10 to about 35 mm or any number or range including or within these values between the front and the rear boundary walls. By dimensioning the opening in this way, the attendant flexural elasticity of the neck is strongly influenced.

In an advantageous further aspect, the opening has an essentially triangular or oval cross section. A triangular longitudinal extension of the opening provides in particular an approximately uniform cross section of the lateral legs on the side of the neck adjacent to the opening in the event that the outer cross section of the neck is likewise configured to be ascending with the cross section of the opening in a direction from the head to the handle.

In another advantageous embodiment, the opening extends in the neck in the same direction as at least part of the mounting holes for the oral care elements in the head. Considering that the mounting holes for oral care elements in the head are as a rule oriented vertically upwardly, e.g., in the form of tufting recesses for toothbrush tufts, the opening in the neck is similarly vertically extended throughout. This configuration not only allows an advantageous neck elasticity to be established but also permits in the manufacturing process the same demolding direction for the injection mold inserts for the openings. The die complexity of the injection mold is therefore kept at a low level.

In another advantageous embodiment, the opening in the neck also extends in the same direction as structural openings (filled, where applicable, with an elastomer) in the hard component basic structure of the handle so that there are die handling advantages in this vertical direction too. In addition, the same orientation of the structural openings in the handle as the orientation of the opening in the neck harmonizes the vertical and horizontal bending characteristic of the neck with that of the handle. Therefore an intensified bending of the neck is introduced into the adjoining region of the handle in the loaded state while brushing the teeth so that no increased stresses arise in the area of transition between the neck and the handle under heavy loading because this front region of the handle is likewise configured to be compliant in the same direction. In addition the user receives, directly in the region in which the toothbrush is held, a sensory feedback signal indicative of an intensified bending load on the neck because the handle in the region of the thumb rest bends as well, thus enabling the user to correct accordingly the application force selected while brushing the teeth.

In another advantageous embodiment, the opening in the neck is oriented in a direction transverse to the mounting holes for the oral care elements in the head. Configuring the opening in this way offers a changed, as a rule more rigid, flexural elasticity in a direction transverse to the mounting holes. The increased stresses on the side legs or boundary walls lateral to the opening in the neck are advantageously absorbed by an elastic muscle in these side legs.

In another advantageous embodiment, the handle of the toothbrush is configured such that its flexural elasticity in a vertical direction, in a region between the thumb rest and the index finger rest adjacent to the neck, is at least 50% greater than its flexural elasticity in a direction turned through 90° transverse thereto over the side of the handle in the same position of the longitudinal extension of the handle. The thumb rest is provided on the upper side of the handle adjacent to the neck, and the index finger rest is provided on the opposite lower side of the handle likewise adjacent to the neck. As used herein, "adjacent to the neck", means up to an extension of 3 or 4 cm from the transition of the neck to the handle. In the front region of the handle around the thumb rest and the index finger rest a bending characteristic is provided which is comparable to that provided preferably for the neck and with which the flexing ability in a vertical direction is significantly greater than the flexing ability in a lateral direction. The flexing ability of the handle in the front region around the thumb rest and the index finger rest or around a center point of the thumb rest in vertical direction is from about 50 to about 1000% or about 100 to about 500% greater than in a direction turned through 90° transverse thereto over the side of the handle in the same position of the longitudinal extension of the handle. Such a bending characteristic can be achieved, for example, by arranging for the side legs or boundary walls of the opening in the neck made of hard plastics material to continue laterally into the front region of the handle and/or by providing in the front region of the handle in the basic structure of the hard plastics material through-openings which can be filled, for example, by a soft elastomer. Accordingly, structural openings are provided in the basic structure of the hard plastic component of the toothbrush which are oriented in the same direction as in particular the opening of the neck so that a good flexing ability of the handle at the thumb rest is obtained.

In another advantageous embodiment, the handle is configured such that its flexural elasticity in a vertical direction, in a region between the thumb rest and the index finger rest adjacent to the neck, is at least 50% greater than its flexural elasticity in the same vertical direction in a central section of the handle mid-way between the free rear end and the front end of the handle adjacent to the neck. The elasticity of the neck is thus introduced into the front region of the handle, while the central and rear region of the handle remain advantageously relatively more rigid to all sides so that the toothbrush can be on the whole well controlled while brushing the teeth.

This aspect can also be provided independently of the previously mentioned aspects and in any combination of previously mentioned single features. This applies equally to the following advantageous embodiments which are claimable likewise independently of the other embodiment features.

The toothbrush has advantageously a flexural elasticity (while brushing the teeth) in a vertical direction around the center of the neck, which is greater than the flexural elasticity in a vertical direction of the handle likewise around the center of the thumb rest at the front end of the handle adjacent to the neck. Therefore the neck is more elastic in the vertical direction than the adjacent handle section, with a continuous transition of the flexural elasticity being preferably provided from the neck into the handle in the vertical bending direction.

In an advantageous embodiment, the toothbrush has in addition a greater flexural elasticity or elastic deformation in the vertical direction of a section of the head relative to a flexural elasticity in the vertical direction around the center of the neck. Therefore, from the head to the neck and to the front part of the handle, and also to the center of the handle, there is a continuous increase in the rigidity of the toothbrush body from the front to the rear, without the flexural elasticity being limited to the head or the neck as is the case in prior art devices.

In another advantageous embodiment of the toothbrush, the thumb rest of the handle is configured on its upper side such that the thumb can be supported on sections of the basic structure. The thumb rest is formed by the first soft plastic component and the basic structure. By the arrangement of several sections of the basic structure in the region of the thumb rest along its longitudinal extension, the thumb rest can be pressed in with the thumb by only between 0 and 3 mm. Therefore the thumb hardly sinks, or does not sink at all, into the thumb rest while brushing the teeth, whereby a good controllability of the toothbrush is obtained.

Further objects, advantages, features and application possibilities of the present invention will become apparent from the subsequent description of embodiments with reference to the accompanying drawings. It will be understood that any feature described and/or represented by illustration, when used singularly or in any meaningful combination, forms the subject-matter of the present invention, also irrespective of their summary in the claims or their back-reference.

DETAILED DESCRIPTION OF THE INVENTION

Figure 1:
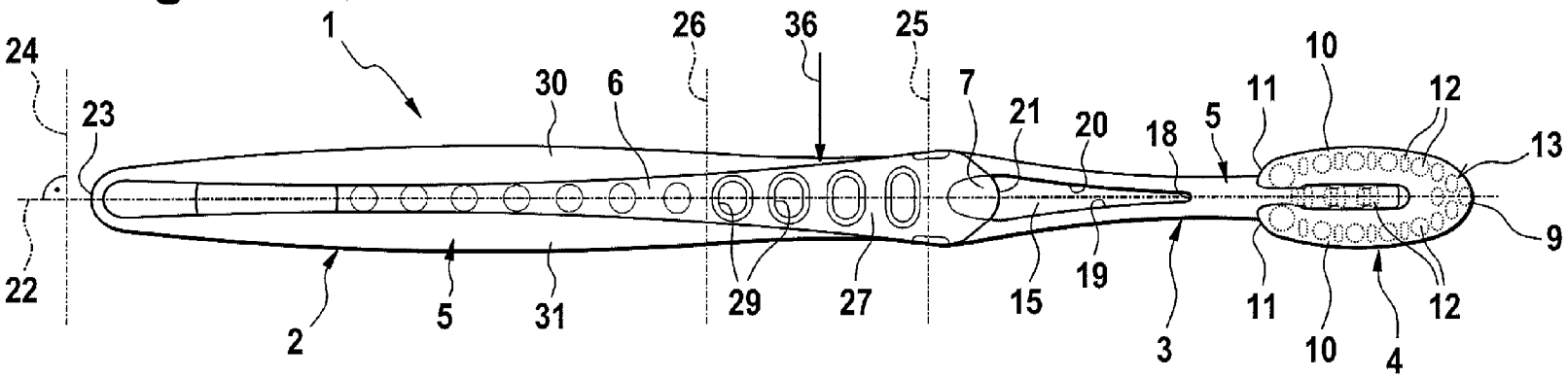
FIG. 1 is a top plan view of the toothbrush of the invention.
Figure 2:
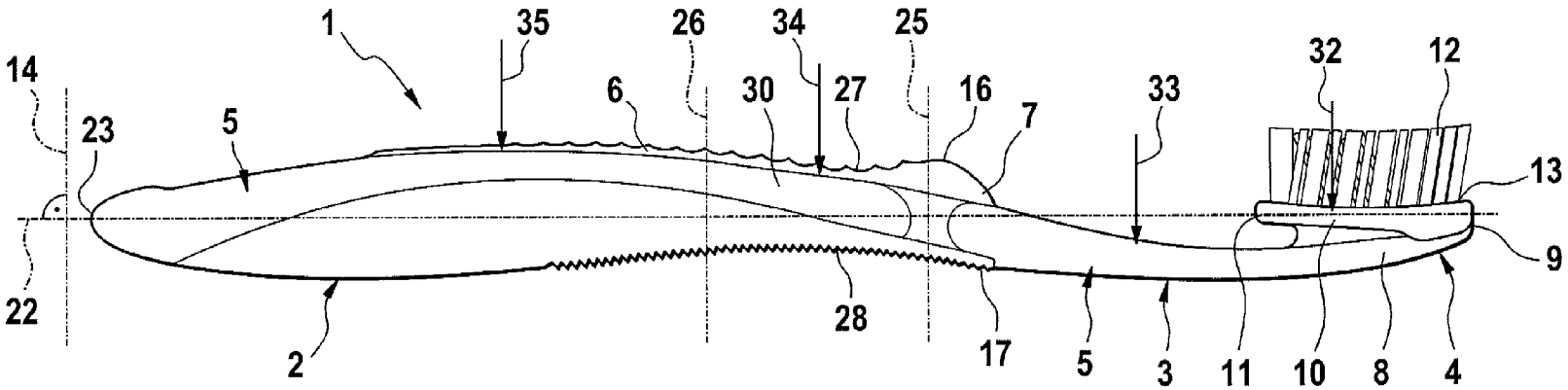
FIG. 2 is a side view of the toothbrush of FIG. 1.

FIGS. 1 and 2 show a first embodiment of the toothbrush. This toothbrush includes a handle 2, a neck 3 and a head 4. The toothbrush is comprised of three plastic components. A basic structure 5 is made of a hard plastics material such as polypropylene. The basic structure 5 will be explained in more detail with reference to FIGS. 4 and 5. A first soft plastic component 6 is provided on the handle 2 and also on the neck in the form of an elastic muscle 7.

The head includes a central support 8 which is a continuation of the basic structure 5 to the front end of the toothbrush. Fastened in the region of the free end 9 of the head is another part of the brush head 4. This additional part is fastened preferably by injection-molding onto the central support 8 at the position 9. The additional part of the brush head 4 is formed by an outer bristle support 10 which is compliant relative to the central support 8. The outer support 10 is a mixture of elastomer and polypropylene. The bristle support 10 is formed in approximately U-shape in the embodiment of FIGS. 1 and 2, with the free ends 11 of the U-legs facing the neck and the handle. Both the central support 8 and the support 10 are equipped with oral care elements. In this embodiment, both bristle supports 8 and 10 are equipped with filament bristle tufts 12. Alternatively it is possible to provide, in addition or exclusively, elastomer cleaning elements or other oral care elements. The filament bristle tufts 12 are affixed in mounting holes or recesses of the central support 8 and the U-shaped support 10 as by injection-molding material around them. These mounting holes 13 are oriented essentially vertically. The Figures show a bristle configuration in which rows of bristle tufts cross each other when viewed from the side. For the sake of simplicity it is assumed that in spite of an inclined arrangement the corresponding mounting holes are oriented vertically upwardly. The corresponding vertical axis 14 is shown in FIG. 2. All references to a vertical orientation in the description are parallels to this vertical axis 14.

The brush head 4 can be configured in accordance with the embodiments of U.S. Patent Application No. 2008/0184511 A1. The content of this U.S. publication is thus incorporated herein by reference. This applies in particular to the mode of operation of the outer movable bristle segments relative to the inner bristle segment, the tufting technique or provision with oral care elements, and the variations thereof.

Figure 3:
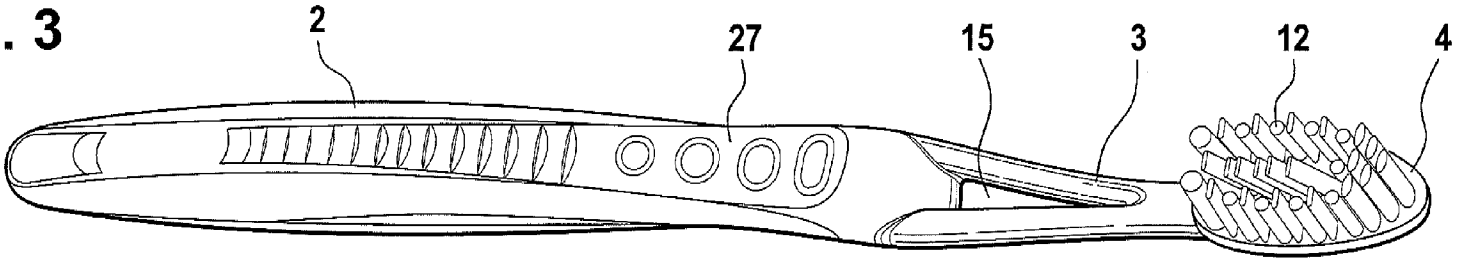
FIG. 3 is a three-dimensional representation of an embodiment slightly modified compared to FIG. 1.

The neck 3 has a through-opening approximately triangular in cross section which extends freely through the neck 3 from an upper side 16 of the toothbrush to a lower side 17 of the toothbrush. The opening 15 in the neck 3 is enclosed by four boundary walls: a front boundary wall 18 adjacent to the head, two lateral boundary walls 19 and 20, which also form side legs of the neck at the opening, and a rear boundary wall 21 which in the embodiment of FIGS. 1, 2 and 3 is enclosed by the elastic muscle 7.

The elastic muscle 7 forms part of the first soft plastic component 6 of the handle 2 and is made preferably from a thermoplastic elastomer.

In conjunction with all the embodiments, a longitudinal axis 22 of the toothbrush is defined as the axis of intersection between the vertical and horizontal longitudinal center planes of the handle. This axis 22 extends from the rear free end 23 of the handle to the front free end 9 of the head 4. The vertical axis 14 is perpendicular to the longitudinal axis 22 and passes through the vertical center plane from the upper side 16 to the lower side 17 of the toothbrush. Also perpendicular to the longitudinal axis 22 is the horizontal transverse axis 24, which lies in a horizontal plane of the toothbrush. Any reference in this description to a transversal or horizontal direction onto the toothbrush represents a parallel to the axis 24. According to this embodiment, the handle 2 is injection-molded from two components, but alternatively to the two-component hard-soft implementation it can also be injection-molded in a three-component hard-hard-soft or hard-soft-soft implementation. Between a front plane 25, which defines the front end of the handle 2 adjacent to the neck, and a plane extending parallel and offset approximately 3 or 4 cm rearwards towards the rear end of the toothbrush, the handle includes a thumb rest 27 on the upper side 16 of the handle and an index finger rest 28 on the lower side 17 of the handle. The surface of the thumb rest 27 is formed by both the hard plastics material of the basic structure and the first soft plastics material of the handle. The hard plastics material projects in the form of several rings from the surface of the thumb rest 27. The small diameters of the hard plastic rings and the small relative distances of the rings of about 2 mm to about 6 mm result in the thumb always resting also on the hard plastic structure of the rings. Therefore the soft plastics material in the region of the thumb rest cannot be pressed in at all or only by a maximum of a few millimeters, such as 2 to 3 mm.

The basic structure 5 includes in the region of the handle 2 a plurality of structural openings 29 whose central axes extend in parallel with the vertical axis 14. The structural openings 29 in the basic structure 5 are filled by the first soft plastic component 6. The structural openings 29 filled with elastomer plastic and the continuation of the side legs 19 and 20 of the lateral boundary walls of the opening in the neck to the lateral walls 30 and 31 made of hard plastics material on the handle 2 produce a specific characteristic of the flexural elasticity of the toothbrush along the longitudinal axis 22. The elastic compliance is greatest in the head region and there in particular in the outer supports 10. An arrow 32 in FIG. 2 shows a corresponding position in the brush head with great flexural elasticity. Relative to this, the flexural elasticity likewise in vertical direction in the neck region is still very high due to the opening 15 and the elastic muscle 7 (see arrow 33 in FIG. 2 for an application force) but smaller compared to the elasticity of the head support segments. The neck in turn is displaceable elastically in vertical direction by a force which is applied at the position 33 centrally on the neck in vertical direction to a greater extent than when the same force is applied at the center of the thumb rest 27 (see arrow 34 in FIG. 2). However, relative to an elastic compliance in vertical direction in the center of the handle (see arrow 35 in FIG. 2 for a force applied by way of example) the vertical elastic compliance in the region of the thumb rest is at least 50% greater than the flexural elasticity in the center 35 of the handle.

The result is therefore a better than average compliance of the head, neck and handle structure in vertical direction, which decreases continuously towards the center of the handle. The elastic compliance in the region of the thumb rest 34 in vertical direction is greater by at least 50% than the elastic compliance in a direction transverse thereto (see the transversal force 36 in FIG. 1).

Figure 5:
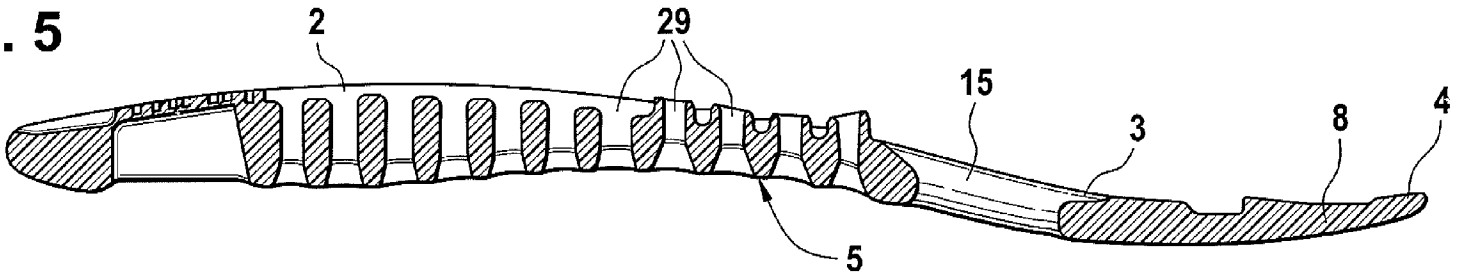
FIG. 5 is a longitudinal sectional view taken along the line A-A of FIG. 4.
Figure 4:
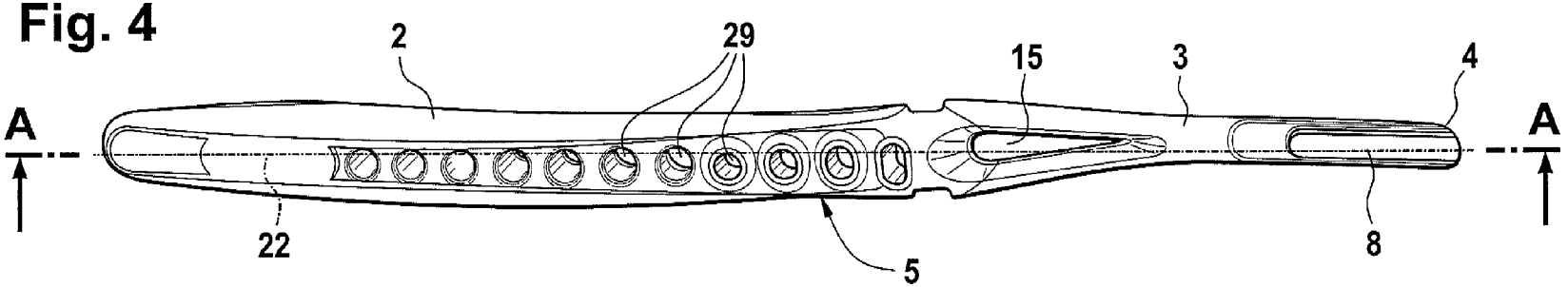
FIG. 4 is a three-dimensional representation of the basic structure of the toothbrush of FIG. 3.

The modified embodiment of FIGS. 3, 4 and 5 differs from the embodiment of FIGS. 1 and 2 substantially in that the opening 15 in the neck is configured to be somewhat shorter in the longitudinal direction along the axis 22.

Figure 6:
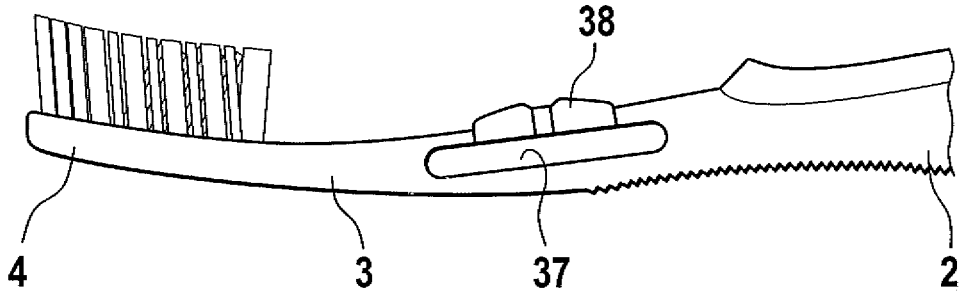
FIG. 6 is a side view of part of another alternative embodiment of the toothbrush of FIG. 1.
Figure 7:
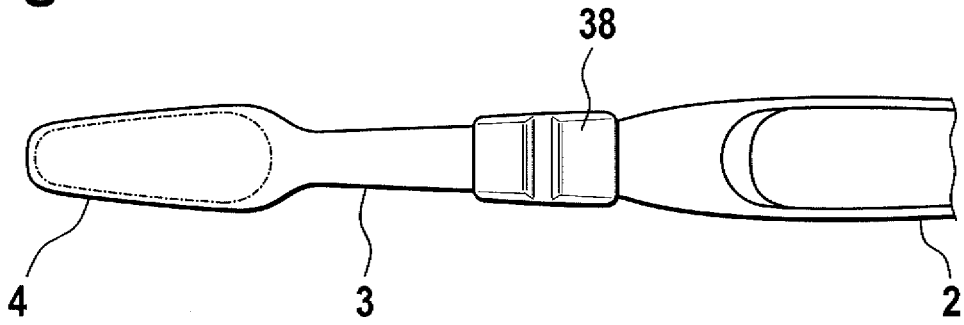
FIG. 7 is a top plan view of the toothbrush part of FIG. 6.

FIGS. 6 and 7 show an alternative embodiment of the toothbrush of FIGS. 1 to 5, one difference residing in an orientation of the opening 37 turned through 90°. The opening 37 extends with a plane which is approximately horizontal or inclined slightly to the horizontal and extends in a direction transverse to the longitudinal axis 22. An upper side leg is provided with an elastic muscle 38 which either covers the hard plastics material of the neck at this location in order to provide a somewhat reduced neck elasticity or replaces the hard plastics material at this location in order to provide the head with a higher elasticity in the vertical direction.

In FIGS. 6 and 7 the elastic muscle is provided on the upper side, i.e., on the same side to which the tooth cleaning elements are attached. Alternatively, the elastic muscle 38 can also be laterally arranged in this embodiment on one of the three other boundary walls at the front, rear or bottom for a different adjustment of the elasticity and flexing ability of the brush head while brushing. FIGS. 6 and 7 show the head and the handle only in a schematically simplified form, alternatively the brush head of FIGS. 1 to 3 and the handle of FIGS. 1 to 3 can also be provided for the embodiment of FIGS. 6 and 7.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A toothbrush having a handle, a head with oral care elements and a neck connecting the head with the handle, the toothbrush further comprising a base structure of the handle, the neck and the head being formed by a hard plastic component, said base structure of the handle being covered at least in part by a first soft plastic component, said head including a second soft plastic component and said neck including a through-opening wherein at least one section of a boundary wall of the opening is provided with an elastic muscle, wherein the opening is encompassed by two lateral boundary walls, one front boundary wall adjacent to the head and one rear boundary wall arranged adjacent to the handle, with the elastic muscle being provided only at one of the lateral, front or rear boundary walls, and wherein the opening has a width of between about 1.5 mm to about 7 mm between the two lateral boundary walls.

2. The toothbrush according to claim 1, wherein the elastic muscle is formed by a third soft plastic component.

3. The toothbrush according to claim 2, wherein the third soft plastic component is identical to the first soft plastic component.

4. The toothbrush according to claim 1, wherein the opening has a length of between about 10 mm to about 35 mm between the front and the rear boundary walls.

5. The toothbrush according to claim 4, wherein the opening has an essentially triangular or oval cross section.

6. The toothbrush according to claim 1, wherein structural openings are provided in the base structure of the handle which extend in the same vertical direction as the opening in the neck.

7. The toothbrush according to claim 1, wherein the handle is configured such that its flexural elasticity in a vertical direction, in a region between a thumb rest and an index finger rest adjacent to the neck, is at least 50% greater than its flexural elasticity in a direction turned through 90° transverse thereto over the side of the handle in the same position of the longitudinal extension of the handle.

8. The toothbrush according to claim 1, wherein the handle is configured such that its flexural elasticity in a vertical direction, in a region between a thumb rest and an index finger rest adjacent to the neck, is at least 50% greater than its flexural elasticity in the same vertical direction in a central section of the handle mid-way between a free rear end and a front end of the handle adjacent to the neck.

9. The toothbrush according to claim 1, wherein a flexural elasticity in a vertical direction around the center of the neck is greater than a flexural elasticity in a vertical direction of the handle around a center of the thumb rest at a front end of the handle adjacent to the neck.

10. The toothbrush according to claim 1, wherein a flexural elasticity in a vertical direction of a section of the head is greater than a flexural elasticity in the vertical direction around the center of the neck.

* * * * *